US006681743B2

(12) United States Patent
de Ojeda

(10) Patent No.: US 6,681,743 B2
(45) Date of Patent: Jan. 27, 2004

(54) PRESSURE CONTROL VALVE WITH FLOW RECOVERY

(75) Inventor: William de Ojeda, Chicago, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 59 days.

(21) Appl. No.: 10/115,339

(22) Filed: Apr. 2, 2002

(65) Prior Publication Data

US 2003/0183197 A1 Oct. 2, 2003

(51) Int. Cl.[7] ..... F09M 55/02
(52) U.S. Cl. ..... 123/446; 123/447; 123/458
(58) Field of Search ..... 123/447, 446, 123/458; 137/487.5

(56) References Cited

U.S. PATENT DOCUMENTS 4,627,403 A * 12/1986 Matsumura ..... 123/447
5,456,233 A * 10/1995 Ffelhofer ..... 123/447
5,460,329 A 10/1995 Sturman
5,485,820 A * 1/1996 Iwaszkiewicz ..... 123/458
5,509,391 A * 4/1996 Degroot ..... 123/467
5,540,203 A * 7/1996 Foulkes et al. ..... 123/446
5,682,858 A 11/1997 Chen et al.
5,701,869 A * 12/1997 Richardson et al. ..... 123/447
5,711,263 A * 1/1998 Brown ..... 123/179.9
5,757,259 A * 5/1998 Fulford et al. ..... 336/92
5,809,771 A * 9/1998 Wernberg ..... 123/447
6,234,128 B1 * 5/2001 Reuss ..... 123/447
6,497,215 B1 * 12/2002 Gaessler et al. ..... 123/447
2001/0054412 A1 * 12/2001 Kojima ..... 123/456

* cited by examiner

*Primary Examiner*—Thomas N. Moulis
(74) *Attorney, Agent, or Firm*—Susan L. Lukasik; Dennis Kelly Sullivan; Jeffrey P. Calfa

(57) ABSTRACT

A pressure control valve assembly for controlling fluid pressure to an actuator, the pressure control valve assembly being in fluid communication with an actuating fluid pump and being disposed intermediate the actuator and the pump, includes an energy storage component, the energy storage component acting on a certain volume of actuating fluid under pressure, the stored energy being selectively releasable to the actuator for augmenting the actuating fluid pressure in the actuator. A method of control is further included.

67 Claims, 5 Drawing Sheets

PRESSURE CONTROL VALVE WITH FLOW RECOVERY

TECHNICAL FIELD

The present invention relates to actuators for use principally with internal combustion engines. More particularly, the present invention relates to hydraulic actuation of actuators, including fuel injectors and camless engine intake/exhaust valves.

BACKGROUND OF THE INVENTION

A prior art hydraulically actuated, intensified injection system (commonly a HEUI injection system) 10 is depicted in prior art FIG. 1 and consists of five major components:

1. Electronic Control Module (ECM) 20
2. Injector Drive Module (IDM) 30
3. High Pressure actuating fluid supply pump 40
4. Rail Pressure Control Valve (RPCV) 50
5. HEUI Injectors 60

Electronic Control Module (ECM) 20

The ECM 20 is a microprocessor which monitors various sensors 22 from the vehicle and engine as it controls the operation of the entire fuel system 10. Because the ECM 20 has many more operational inputs than a mechanical governor, it can determine optimum fuel rate and injection timing for almost any condition. Electronic controls such as this are absolutely essential in meeting standards of exhaust emissions and noise.

Injector Drive Module (IDM) 30

The IDM 30 is communicatively coupled to the ECM 20 and receives commands therefrom. The IDM 30 sends a precisely controlled current pulse to energize the solenoid of each injector 60. Such energization acts to port high pressure actuating fluid to the intensifier of the respective injector 60. The timing and duration of the IDM 30 pulse are controlled by the ECM 20. In essence, the IDM 30 acts like a relay.

High Pressure Actuating Fluid Supply Pump 40

The high pressure actuating fluid supply pump 40 is a single stage pump and is in the prior art, typically a seven piston fixed displacement axial piston pump and is driven by the engine. The high pressure actuating fluid supply pump 40 draws in low pressure actuating fluid (most commonly engine oil, but other actuating fluids could be used as well) from the reservoir 46, elevates the pressure of the actuating fluid for pressurization of the accumulator or rail 42. The rail 42 is plumbed to each injector 60. During normal engine operation, pump output pressure of the high pressure actuating fluid supply pump 40 is controlled by the rail pressure control valve (RPCV) 50, which dumps excess flow back to the return circuit 44 to the reservoir 46. The reservoir 46 is at substantially ambient pressure and may be at the normal pressure of the lubricating oil circulating in the engine of about 50 psi. Pressures in the rail 42 for specific engine conditions are determined by the ECM 20.

Rail Pressure Control Valve (RPCV) 50

The RPCV 50 is an electrically operated dump valve, which closely controls pump output pressure of the high pressure actuating fluid supply pump 40 by dumping excess flow to the return circuit 44 thence and to the reservoir 46. A variable signal current from the ECM 20 to the RPCV 50 determines output pressure of the pump 40. Pump output pressure is maintained anywhere between about 450 psi and 3,000 psi during normal engine operation. When the actuating fluid is engine lubricating oil, pressure while cranking a cold engine (below 50 degrees F.) is slightly higher because cold oil is thicker and components in the respective injectors 60 move slower. The higher pressure helps the injector 60 to fire faster until the viscosity of the actuating fluid (oil) is reduced.

HEUI Injector 60

Injectors 60 of the HEUI type are known and are representatively described in U.S. Pat. Nos. 5,460,329 and 5,682,858, incorporated herein by reference. The injector 60 includes an intensifier piston and plunger, the actuating fluid acting on the intensifier to pressurize a volume of fuel acted upon by the plunger. The injector 60 uses the hydraulic energy of the pressurized actuating fluid (preferably, lubricating oil) to dramatically increase the pressure of the volume of fuel and thereby to cause injection. Actuating fluid is ported to the intensifier by a valve controlled by a solenoid. The pressure of the incoming actuating fluid from the rail 42 controls the speed of the intensifier piston and plunger movement, and therefore, the rate of injection. The amount of fuel injected is determined by the duration of the pulse from the IDM 30 and how long it keeps the solenoid of the respective injector 60 energized. The intensifier amplifies the pressure of the actuating fluid and elevates the pressure of the fuel acted upon by the plunger from near ambient to about 20,000 psi for each injection event. As long as the solenoid is energized and the valve is off its seat, high pressure actuating fluid continues to translate the intensifier and plunger to continuously pressurize fuel for injection until the intensifier reaches the bottom of its bore.

In the prior art fuel injection system 10, pressurized actuating fluid is used to control the injected fuel quantity by using pressure amplification in the injectors 60. As noted above, a pressure source (pump 40) pumps actuating fluid to a pressure rail 42 (accumulator) where pressure is regulated according to the engine load and speed requirement. The pressure regulation is done via the rail pressure control valve 50 that dumps some of the pressurized actuating fluid to ambient (reservoir 46) in order to maintain the desired pressure in the rail 42.

Prior Art Rail RPCV 50

The RPCV 50 is an electronically controlled, pilot operated valve. The basic components of the RPCV 50 are depicted in Prior Art FIG. 2 and include:

Body 51
Spool valve 52
Spool spring 53
Poppet 54
Push pin 55
Armature 56
Solenoid 57
Edge filter 58
Drain Port 59

The RPCV 50 controls pump outlet pressure of pump 40 in a range between about 450 and 3,000 psi. An electrical signal to the solenoid 57 from the ECM 20 creates a magnetic field which applies a variable force on the armature 56, shifting the poppet 54 to control pressure. With the engine off, the valve spool 52 is held to the right by the return spring 53 and the drain ports 59 are closed.

Approximately 1,500 psi of oil pressure is required to start a relatively warm engine. If the engine is cold (coolant temperatures below 32° F.), 3,000 psi of oil pressure is typically commanded by the ECM 20. Initially, pump outlet pressure enters the end of the body 51 and a small amount of oil flows into the spool valve 52 chamber through the pilot stage filter screen and control orifice in the end of the spool valve 52. The electronic signal causes the solenoid 57 to generate a magnetic field which pushes the armature 56 to the right. The armature 56 exerts a force on the push pin 55 and poppet 54 holding the poppet 54 closed allowing spool chamber pressure to build. The combination of spool spring 53 force and spool chamber pressure hold the spool valve 52 to the right, closing the drain ports 59. All oil is directed to the pressure rail 42 until the desired pressure is reached.

Once the engine starts, the ECM 20 sends a signal to the RPCV 50 to give the rail pressure desired. The injection control pressure sensor 22 monitors actual rail pressure. The ECM 20 compares the actual rail pressure to the desired rail pressure and adjusts the signal to the RPCV 50 to obtain the desired rail pressure. The pressure in the spool chamber is controlled by adjusting the position of the poppet 54 and allowing it to bleed off some of the oil in the spool chamber through the drain port 59. The position on the poppet 54 is controlled by the strength of the magnetic field produced from the electrical signal from the ECM 20. The spool valve 52 responds to pressure changes in the spool chamber (left side of the spool) by changing positions to maintain a force balance between the right and left side of the spool. The spool valve 52 position determines how much area of the drain ports 59 are open. The drain port 59 open area directly affects how much oil is bled off from the outlet of the pump 40 and directly affects rail pressure in the rail 42. The process of responding to pressure changes on either side of the spool valve 52 occurs so rapidly that the spool valve 52 is held in a partially open position and outlet pressure of the pump 40 is closely controlled by venting a significant volume of the actuating fluid out the drain ports 59 under certain engine operating conditions, primarily at the lower engine load conditions. The RPCV 50 provides for substantially infinitely variable control of pump outlet pressure between 450 psi and 3,000 psi.

In the prior art, injection pressure is controlled with the electronically controlled pressure-regulating valve, RPCV 50, as noted above. The hydraulic supply pump 40 is deliberately selected to provide excess output to ensure that the rail 42 is sufficiently supplied with actuating fluid at the highest demand conditions of the engine (full load conditions). The RPCV 50 valve relieves high oil pressure to tank 46 (ambient) to maintain desired pressure in the rail 42 at all engine conditions when the maximum actuating fluid is not required. Typically, engines operate under full load only a very small percentage of the total operating time. This results in significant wasted pumping energy, which has a significant negative fuel economy effect on the engine. Further, during the injection event, the flow consumption rate of the injector 60 exceeds greatly the instantaneous pump flow recovery and causes large pressure drops in the rail 42. There is therefore a need to better control fluid pressure in the fuel injection high-pressure rail 42 and compensate for large instantaneous fluid flow requirements by the injectors 60.

SUMMARY OF THE INVENTION

The regulating valve of the present invention substantially meets the aforementioned needs. The regulating valve minimizes the pressure drop in the rail caused by injection events and the time for pressure recovery. Effectively, the regulating valve advantageously lessens the requirements of oil displacement by both the high-pressure pump and rail size. Ultimately, the regulating valve of the present invention advantageously improves the stability of the fuel injection system (shot-to-shot and injector-to-injector variability).

The regulating valve of the present invention stores oil at a low pressure during the pressure regulating cycle rather than discharging it to ambient as in the prior art. The low-pressure oil is then used to pressurize oil in the rail during the injection event. The flow-recovery regulating valve replaces the prior art injection pressure regulator valve, RCPV 50.

The instant regulating valve is built on the principles of an RCPV with the addition of a dual acting piston and low-pressure relief. The main control spool of the RCPV is modified to allow a low-pressure to vent scheduled transition during flow recovery. The dual acting piston is responsible for the flow recovery. The low-pressure relief allows storage energy in the dual acting piston that is then made available to the rail 42 as needed by the actuators (injectors 60).

The main contributions of the regulating valve of the present invention are:

(a) increase the pressure recovery rate in the fuel injection high-pressure oil rail following an injection event;

(b) decrease the pressure drop in the rail due to the injection event;

(c) minimize the fluid volume requirement for the rail; and (d) minimize the displacement requirement of the high pressure pump.

Items (a) and (b) above directly affect the stability of shot-to-shot and injector-to-injector performance of the fuel injection system. Item (c) improves the package of the fuel injection system by minimizing the physical size of the rail installed in an area of the engine in which many engine components compete for a very limited space available. Item (d) improves the power output of the engine by lessening the power draw from the high pressure pump.

The present invention is a pressure control valve assembly for controlling fluid pressure to an actuator (such as fuel injectors or camless hydraulic actuators), the pressure control valve assembly being in fluid communication with an actuating fluid pump and being disposed intermediate the actuator and the pump. The invention includes an energy storage component, the energy storage component acting on a certain volume of actuating fluid under pressure, the stored energy being selectively releasable to the actuator for augmenting the actuating fluid pressure in the actuator. The present invention is further a method of control.

DETAILED DESCRIPTION OF THE DRAWINGS

Figure 1:
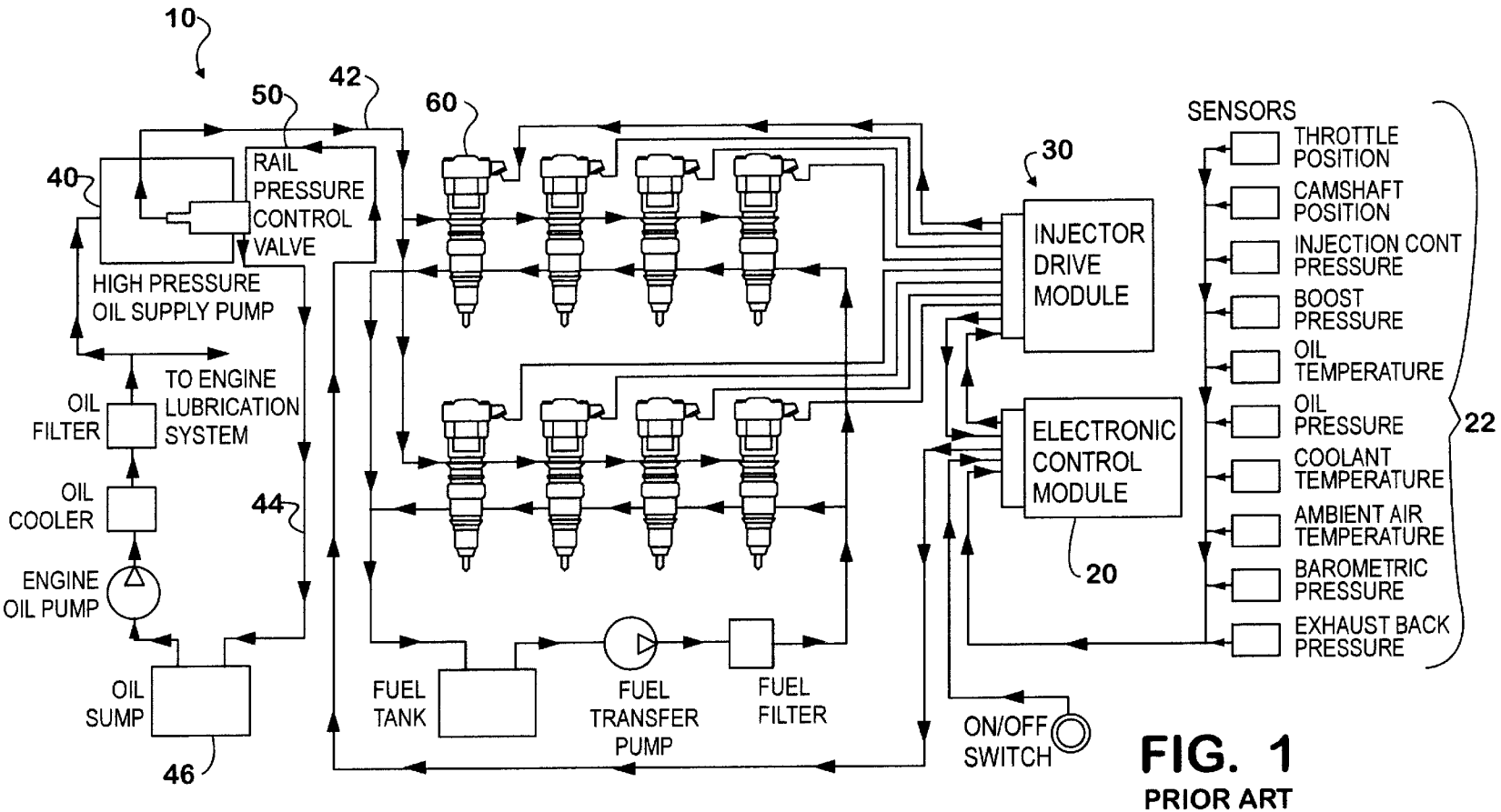
FIG. 1 PRIOR ART
FIG. 1 is a schematic of a prior art HEUI fuel system.
Figure 2:
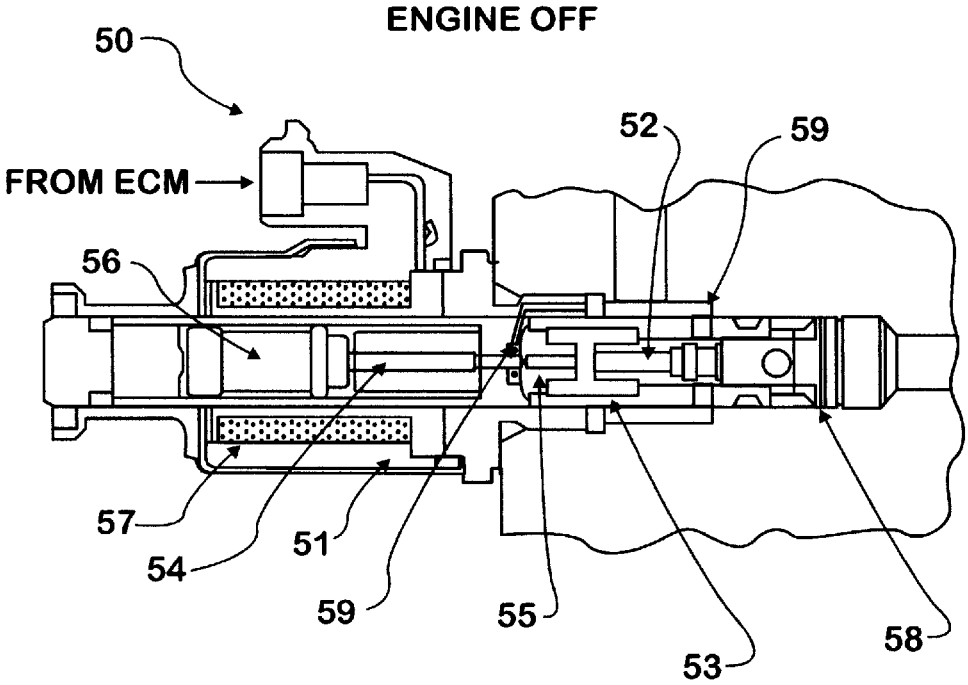
FIG. 2 PRIOR ART
FIG. 2 is a sectional view of a prior art RPCV.
Figure 3:
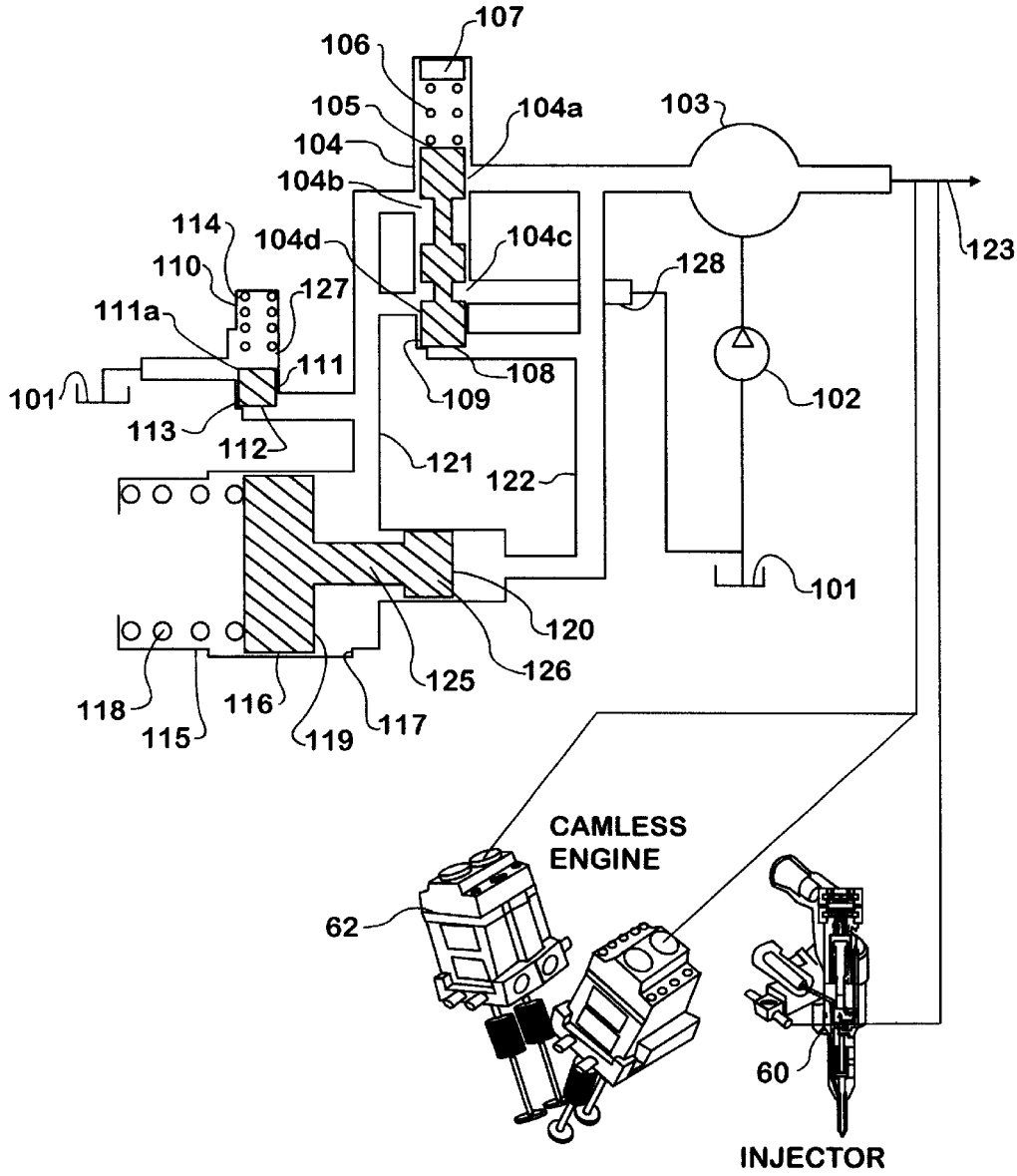
FIG. 3 is a schematic representation of the regulating valve of the present invention under conditions of no system pressure.
Figure 4:
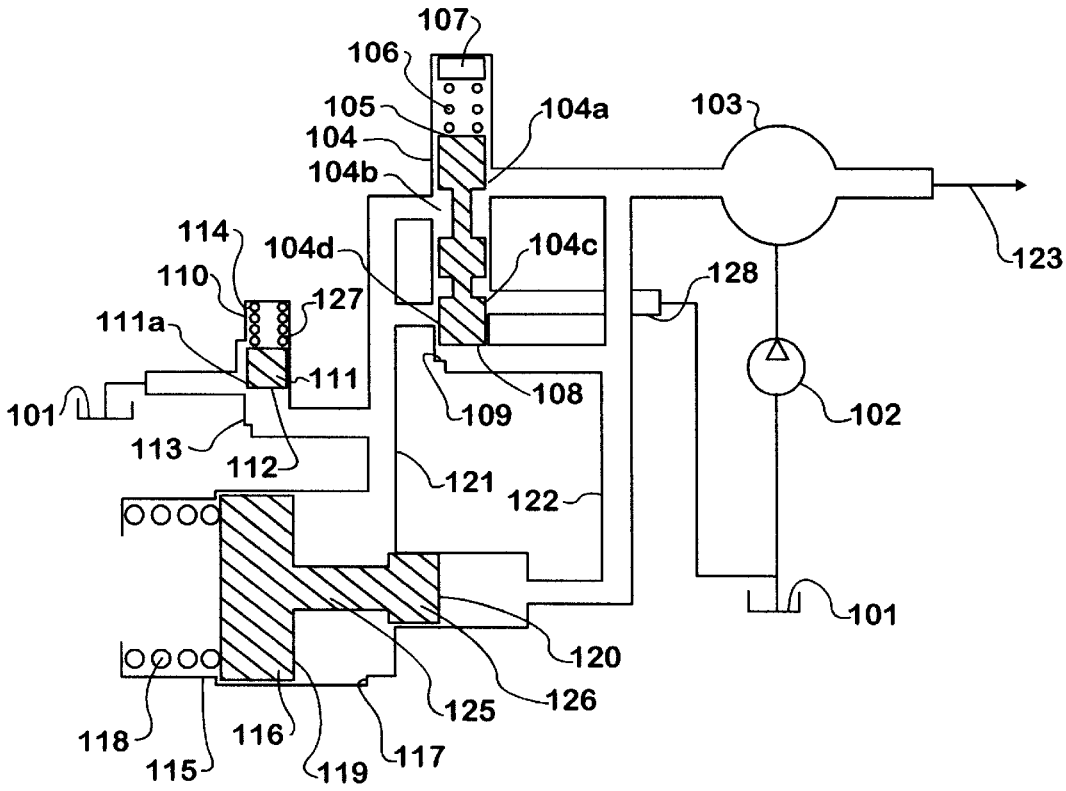
FIG. 4 is a schematic representation of the regulating valve of the present invention under conditions of system pressure.
Figure 5:
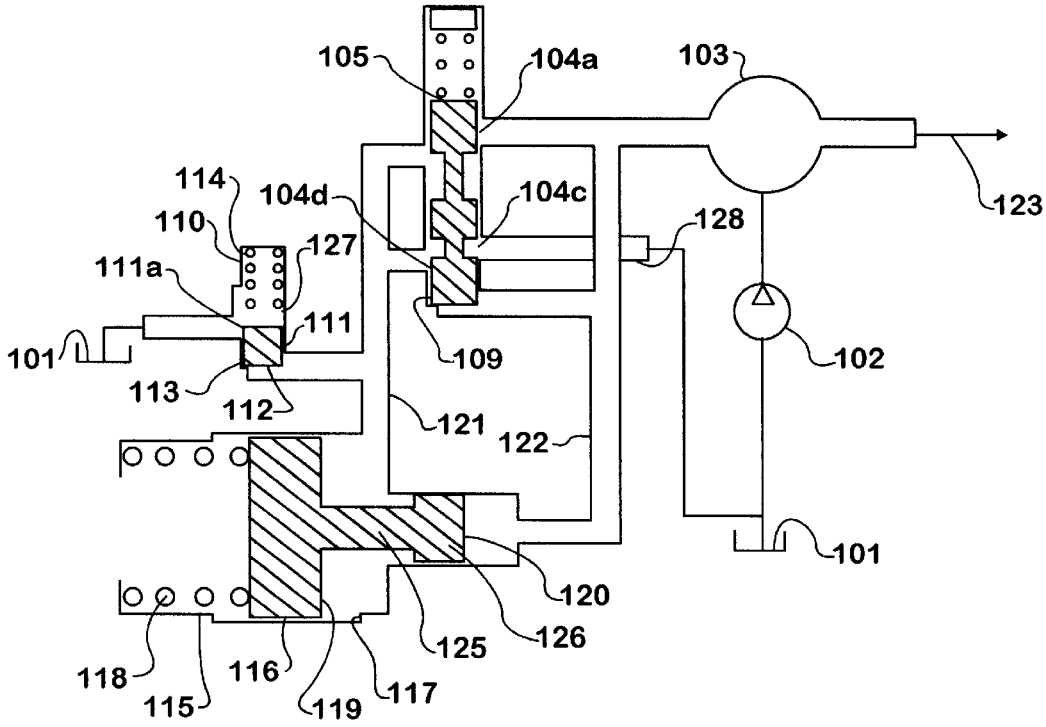
FIG. 5 is a schematic representation of the regulating valve of the present invention responsive to a quick oil demand.

The regulating valve of the present invention is shown generally at 100 in FIGS. 3–5. The regulating valve 100 fluidly controls pressure in the accumulator rail 42 while at the same time compensating for large instantaneous fluid flow requirements due to injection events of the respective injectors 60.

The motivation for the regulating valve 100 is to minimize the displacement requirements of the pump 40 and the accumulator (rail) 42 size. High-pressure systems are designed around fluid consumption requirements demanded by the actuation device 123 (injectors 60 and camless engine intake/exhaust valves 62). The instantaneous flowrate demand and the cycling rate, in conjunction with the particular specifications of the device, establish the size of the pump 40 displacement and the accumulator 42 size. Modern systems such as used in fuel injector 60 applications and hydraulic based camless intake/exhaust valve systems 62 demand fast and immediate oil delivery and thus very large size pumps 40 and accumulators 42. However, large displacement pumps 40 often times yield low efficiency and oversized accumulators 42 are hard to package in the limited real estate of an engine. Large displacement pumps 40 help the system meet the instantaneous flow requirements, minimum pressure drop requirements in the accumulator 42 during the actuation event and desired pressure recovery rates. However, the instantaneous flow requirements are met at the expense of wasting high pressure fluid during the overall or average device cycle, where fluid is vented through a relief valve or an electronically regulated controlled pressure valve 50 as noted with respect to the prior art above. The venting is required to keep pressure at the desired point while still having the capacity to meet the highest device demands.

Generally, the regulating valve 100 of the present invention relies on a dual acting piston 125, described in more detail below, that operates according to a designed area schedule in a pressure regulator spool. The dual acting piston 125 comprises two coupled pistons 116, 126. The first piston 116, spring loaded and of large area 119, is exposable to relatively low pressure. The second piston 126, of smaller area 120, is exposable to the pressure high-pressure fluid accumulator 103 (rail 42).

All pressure relief performed by the regulating spool 105 from the high-pressure accumulator 103 (rail 42 in the prior art injection system) is discharged to a low-pressure reservoir 121, where, after overcoming the force of the spring 118 of the dual acting piston 125, compressing the spring 118 results in energy stored at the pre-load potential of the spring 118. When a large, immediate, demand for fluid in the high-pressure accumulator 103 by the activation device 123 takes place, the pressure drop forces the regulating spool 105 to allow full flow of oil from the pump 102 (40 in the prior art injection system) to the accumulator 103 (rail 42 in the prior art injection system). The spool 105 schedule is also designed to vent oil from the low-pressure reservoir 121 and allow the force of preloaded spring 118 to act on the low area piston 126 exposed to the high-pressure accumulator via passage 122. Fluid thus stored at low potential during the portion of no valve actuation is used to pressurize the high-pressure accumulator 103 during actuation of the actuation device 123.

More particularly, FIG. 3 shows the main components of the system in reference to a tank volume 101 at substantially atmospheric conditions, pump 102, and high-pressure accumulator 103. The regulating valve 100 arrangement is composed of a regulator spool housing 104 and spool 105, low-pressure relief valve housing 110 and piston 111, and a coupled dual acting piston 125 contained within a housing 115. The dual acting piston 125 is responsible for the flow and pressure recovery as described below.

The regulating spool 105 adjusts the pressure in the high-pressure accumulator 103. Fluid at ambient conditions form reservoir 101 is pressurized by a pump 102 and piped into the high-pressure accumulator 103. The pressure is regulated by the spool spring 106 set by a variety of methods, one of which is shown as the preload length 107 depicted on FIG. 3, which effects a known preload on the spring 106. Fluid from the accumulator 103, through passage 122, exerts a force on the spool face 108 and compresses the spring 106. Fluid in the high-pressure accumulator 103 is thus relieved to the low-pressure passage 121 through openings in the spool 104*a* and 104*b* as the spool 105 is moved upward by the actuating fluid pressure force acting on surface 108. The opening 104*d* in the spool housing 104 is open (as depicted in FIG. 3) when pressure in the accumulator 103 is low. Otherwise, during typical pressure regulating activity, opening 104*d* is closed. Opening 104*c* is open and connects to ambient. With no system pressure, the regulator spool 105 is resting against stop 109.

Pressure in volume 121 is at a lower level than in the high-pressure accumulator 103, and is set to a lower value than the required low-level specification for the high-pressure accumulator 103. The pressure in volume 121 is controlled via a low-pressure regulator valve 127 depicted in housing 110 and having a spool 111. Pressure is controlled by the preload and stiffness of the spring 114 acting on the spool 111. Fluid forces act on the surface area 112 of spool 111. Relief flow exits through opening 111*a* to tank 101. With no system pressure, the spool 11 is resting against stop 113, as depicted in FIG. 3.

Low-pressure fluid in chamber 121 acts against surface 119 of the dual acting piston 125 (translatably positioned within housing 115) against spring 118. Surface 120 of the dual acting piston 125 is exposed to the same high-pressure fluid of accumulator 103 through passage 122. Displacing the dual acting piston 125 by high-pressure fluid acting simultaneously on surfaces 119, 120 against the bias of the spring 118 effectively stores energy. The energy stored in the spring 118 is then used to generate flow and pressure when large consumptions occur due to system requirements 123 such as fuel injector valves and camless valves, as described below. With no system pressure the dual acting piston 125 is resting against stop 117. The surface area at 120 is designed so the spring force of spring 118 yields sufficient pressure on the actuating fluid in passage 122 during recovery.

Operation

FIG. 3 shows the arrangement with no system pressure. The regulator spool 105 is up against its stop 109 due to the bias of the spring 106. Similarly the low-pressure relief spool 111 is against its seat 113 and the dual acting piston 116 is against it stop 117. The following figures show the operation of the device when the pump 102 is activated.

FIG. 4 shows the regulator spool 105 under pressure load on surface 108. Equilibrium is maintained between the pressure load and the spring force of spring 106 by the relief opening 104*a* in the housing 104. Fluid is discharged through opening 104*b* to passage 121. The pressure in passage 121 is controlled via the low-pressure relief spool 111. FIG. 4 shows the area opening 111*a* in the housing 111, self-adjusted to maintain the proper low-pressure setting, determined by the spring 110. The fluid in the low-pressure passage 121 acts on surface 119 and forces the dual acting piston 116 against the spring 118, translating the piston 125 and compressing the spring 118. High-pressure fluid, acting on surface 120 also contributes to the translational displacement of the dual acting piston 116. In this arrangement, the system has energy stored in the compressed spring 118 which is available for use when there is a sudden request of oil from the high-pressure accumulator 103, as is explained below.

FIG. 5 shows the response of the regulator spool 105 to a quick oil demand from device 123. Pressure drops in passage 122. The spring 106 quickly shifts the regulator spool 105 downward to close the relief port 104*a* when the quick oil demand of device 123 exceeds the pump displacement of the pump 102. All the oil available from the pump 102 is used to fill the high-pressure accumulator 103. Under these conditions, port 104*d* opens and vents the fluid in section 121 to the ambient tank 101 via port 104*c* and passage 128. FIG. 5 shows the corresponding position of the spool 111 of the low-pressure relief valve 127 as the pressure in passage 121 is vented. The drop in pressure in passage 121 results in spring 114 shifting the valve 111 downward, closing off the port 111*a*. With the venting of fluid pressure in passage 121, the spring 118 is now is capable of displacing the dual acting piston 125, since pressure on surface 119 is near atmospheric. The energy of the compressed spring 118 is therefore transferred to build pressure on surface 120 and thus build pressure on the high-pressure accumulator 103 via passage 122, thereby recovering pressure (energy) that otherwise would have been lost. This pressure is transferred directly to the accumulator 103 for use by the actuating device 123. Such recovery permits reducing the volume of the accumulator 103 and reducing the displacement of the pump 102 while effecting the same actuation of the actuating device 123.

It will be obvious to those skilled in the art that other embodiments in addition to the ones described herein are indicated to be within the scope and breadth of the present application. Accordingly, the applicant intends to be limited only by the claims appended hereto.

What is claimed is:

1. A rail pressure control valve (RPCV) assembly for controlling pressure in an accumulator, the accumulator being a rail conveying an actuating fluid, the RPCV assembly being in fluid communication with an actuating fluid pump and the rail, comprising:

an energy storage component being charged by fluid pressure from the rail, the energy storage component acting on a certain volume of actuating fluid under pressure, the stored energy being selectively dischargeable to the rail for augmenting the actuating fluid pressure in the rail when a drop in fluid pressure is experienced in the rail due to a fuel injection event.

2. The RPCV assembly of claim 1, the energy storage component increasing an energy recovery rate in the rail following an event that demands a supply of actuation fluid from the rail.

3. The RPCV assembly of claim 1, the energy storage component decreasing a pressure drop in the rail following an event that demands a supply of actuation fluid from the rail.

4. The RPCV assembly of claim 1, the energy storage component acting to supplement a reduced rail volume with a volume of actuating fluid under pressure.

5. The RPCV assembly of claim 4, the energy storage component where the supplemental volume of actuating fluid under pressure cooperates with a minimized displacement actuating fluid pump to satisfy rail actuating fluid volume and pressure requirements.

6. The RPCV assembly of claim 1, the energy storage component having a fluid storage volume for storing actuating fluid at a certain pressure.

7. The RPCV assembly of claim 6, fluid pressure in the fluid storage volume being controlled by a low-pressure regulator valve, the low-pressure regulator valve being disposed intermediate and in fluid communication with a substantially ambient pressure reservoir and the fluid storage volume.

8. The RPCV assembly of claim 7, the low-pressure regulator valve being controlled by a preload and a stiffness of a spring, the spring acting to bias a spool.

9. The RPCV assembly of claim 8, the low-pressure regulator valve spool having a surface being exposed to the actuating fluid in the fluid storage volume, fluid pressure acting on the spool surface generating a force in opposition to the preload and a stiffness of the spring.

10. The RPCV assembly of claim 7, the low-pressure regulator valve controlling fluid pressure in the fluid storage volume to a pressure that is less than a required low-level pressure specification for the rail.

11. The RPCV assembly of claim 6, the fluid storage volume being formed in part by an actuating surface of a translatable piston.

12. The RPCV assembly of claim 11, the fluid storage volume being variable.

13. The RPCV assembly of claim 6, the fluid storage volume being formed in part by a first actuating surface of a dual acting piston, the dual acting piston first actuating surface being in fluid communication with the fluid storage volume and a dual acting piston second actuating surface being selectively fluidly communicable with actuating fluid in the rail.

14. The RPCV assembly of claim 13, fluid pressure acting on the dual acting piston first actuating surface acting in cooperation with fluid pressure acting on the second actuating surface to translate the piston in a first direction.

15. The RPCV assembly of claim 14, a spring exerting a bias on the dual acting piston in a second opposed direction relative to the fluid pressure acting on the dual acting piston first actuating surface.

16. The RPCV assembly of claim 13, the dual acting piston first actuating surface having an area that is substantially greater than the second actuating surface area.

17. The RPCV assembly of claim 13, the energy storage component acting on a certain volume of actuating fluid under pressure, the stored energy being selectively dischargeable to the rail for augmenting the actuating fluid pressure in the rail without adding a volume of fluid to the rail.

18. A pressure control valve assembly for controlling fluid pressure to an actuator, the pressure control valve assembly being in fluid communication with an actuating fluid pump and an actuator accumulator, the accumulator being selectively in fluid communication with the actuator, comprising:

an energy storage component being charged by fluid pressure from the actuator accumulator, the energy storage component acting on a certain volume of actuating fluid under pressure, the stored energy being selectively dischargeable to the actuator accumulator for augmenting the actuating fluid pressure to the actuator accumulator between fuel injection events.

19. The pressure control valve assembly of claim 18, the energy storage component increasing an energy recovery rate of actuating fluid available to the actuator following an event that demands a supply of actuation fluid to the actuator.

20. The pressure control valve assembly of claim 18, the energy storage component decreasing a pressure drop in actuating fluid pressure available to the actuator accumulator following an event that demands a supply of actuation fluid to the actuator.

21. The pressure control valve assembly of claim 18, the energy storage component acting to supplement a reduced actuating fluid pressure in the actuator accumulator with increased actuating fluid pressure with out the addition of volume of actuating fluid to the actuator accumulator.

22. The pressure control valve assembly of claim 21, the energy storage component where the supplemental actuating fluid pressure cooperates with a minimized displacement actuating fluid pump to satisfy actuating fluid pressure requirements of the actuator.

23. The pressure control valve assembly of claim 18, the energy storage component having a fluid storage volume for storing actuating fluid at a certain pressure.

24. The pressure control valve assembly of claim 23, fluid pressure in the fluid storage volume being controlled by a low-pressure regulator valve, the low-pressure regulator valve being disposed intermediate and in fluid communication with a substantially ambient pressure reservoir and the fluid storage volume.

25. The pressure control valve assembly of claim 24, the low-pressure regulator valve being controlled by a preload and a stiffness of a spring, the spring acting to bias a spool.

26. The pressure control valve assembly of claim 25, the low-pressure regulator valve spool having a surface being exposed to the actuating fluid in the fluid storage volume, fluid pressure acting on the spool surface generating a force in opposition to the preload and a stiffness of the spring.

27. The pressure control valve assembly of claim 24, the low-pressure regulator valve controlling fluid pressure in the fluid storage volume to a pressure that is less than a required low-level pressure specification for the actuator accumulator.

28. The pressure control valve assembly of claim 23, the fluid storage volume being formed in part by an actuating surface of a translatable piston.

29. The pressure control valve assembly of claim 28, the fluid storage volume being variable.

30. The pressure control valve assembly of claim 23, the fluid storage volume being formed in part by a first actuating surface of a dual acting piston, the dual acting piston first actuating surface being in fluid communication with the fluid storage volume and a dual acting piston second actuating surface being selectively fluidly communicable with actuating fluid in the actuator.

31. The pressure control valve assembly of claim 30, fluid pressure acting on the dual acting piston first actuating surface acting in cooperation with fluid pressure acting on the second actuating surface to translate the piston in a first direction.

32. The pressure control valve assembly of claim 31, a spring exerting a bias on the piston in a second opposed direction relative to the fluid pressure acting on the dual acting piston first actuating surface.

33. The pressure control valve assembly of claim 30, the dual acting piston first actuating surface having an area that is substantially greater than the second actuating surface area.

34. The pressure control valve assembly of claim 30, the energy storage component acting on a certain volume of actuating fluid under pressure, the stored energy being selectively dischargeable to the actuator accumulator for augmenting the actuating fluid pressure in the actuator accumulator without adding a volume of fluid to the actuator accumulator.

35. The pressure control valve assembly of claim 18, wherein the actuator is at least one of a fuel injector and a hydraulically-actuated, intensified fuel injector.

36. The pressure control valve assembly of claim 18, wherein the stored energy is selectively dischargeable to the actuator accumulator to augment the actuating fluid pressure to the actuator accumulator between consecutive fuel injection events to minimize at least one of fluid pressure drop caused by fuel injection events in a rail operatively coupled to the energy component and time for pressure recovery in the rail.

37. The pressure control valve assembly of claim 18, wherein the actuator is a camless engine intake/exhaust valve.

38. A method of controlling actuating fluid pressure in an accumulator, the accumulator being in fluid communication with an actuating fluid pump and with at least one actuator, comprising:

charging an energy storage component with fluid pressure from the accumulator;

after a fuel injection event, detecting an actuating fluid pressure drop;

acting on a certain volume of actuating fluid under pressure by means of energy charged on the energy storage component; and selectively discharging energy to the accumulator for augmenting the actuating fluid pressure to the actuator prior to a subsequent fuel injection event.

39. The method of claim 38, the energy storage component increasing an energy recovery rate of actuating fluid available to the actuator following an event that demands a supply of actuation fluid to the actuator.

40. The method of claim 38, including decreasing a pressure drop in actuating fluid available to the actuator following an event that demands a supply of actuation fluid to the actuator.

41. The method of claim 38, including supplementing a reduced actuating fluid pressure with increased actuating fluid pressure with out the addition of volume of actuating fluid.

42. The method of claim 41, including satisfying actuator actuating fluid pressure requirements of the actuator by the supplemental actuating fluid pressure cooperating with a displacement of a minimized displacement actuating fluid pump.

43. The method of claim 38, including storing actuating fluid at a certain pressure in a fluid storage volume.

44. The method of claim 43, including controlling fluid pressure in the fluid storage volume by a low-pressure regulator valve, the low-pressure regulator valve being disposed intermediate and in fluid communication with a substantially ambient pressure reservoir and with the fluid storage volume.

45. The method of claim 44, the low-pressure regulator valve being controlled by a preload and a stiffness of a spring, the spring acting to bias a spool.

46. The method of claim 45, including exposing a low-pressure regulator valve spool surface to the actuating fluid in the fluid storage volume and generating a force in opposition to the preload and a stiffness of the spring by the fluid pressure acting on the spool surface.

47. The method of claim 44, including controlling fluid pressure in the fluid storage volume to a pressure that is less than a required low-level pressure specification for the actuator by means of the low-pressure regulator valve.

48. The method of claim 43, including forming the fluid storage volume in part by an actuating surface of a translatable piston.

49. The method of claim 48, including variably forming the fluid storage volume.

50. The method of claim 43, including forming the fluid storage volume in part by an actuating surface of a dual acting piston, fluidly communicating a dual acting piston first actuating surface with the fluid storage volume and fluidly communicating a dual acting piston second actuating surface with actuating fluid in the accumulator.

51. The method of claim 50, including translating the dual acting piston in a first direction by the fluid pressure acting on the dual acting piston first actuating surface acting in cooperation with fluid pressure acting on the second actuating surface.

52. The method of claim 51, including exerting a spring bias on the piston in a second opposed direction relative to the fluid pressure acting on the dual acting piston first actuating surface.

53. The method of claim 50, the dual acting piston first actuating surface having an area that is substantially greater than the second actuating surface.

54. The method of claim 50, including selectively releasing the stored energy to the actuator for augmenting the actuating fluid pressure in the accumulator without adding a volume of fluid to the accumulator.

55. The method of claim 38, including defining the actuator as at least one of a fuel injector and a hydraulically-actuated, intensified fuel injector.

56. The method of claim 28, wherein the step of discharging energy minimizes at least one of fluid pressure drop caused by fuel injection events in a rail operatively coupled to the energy component and time for pressure recovery in the rail.

57. The method of claim 38 including defining the actuator as a camless engine intake/exhaust valve.

58. The pressure control valve assembly of claim 18 including a regulating valve 104 being in fluid communication with the accumulator.

59. The pressure control valve assembly of claim 58, the regulating valve selectively relieving pressure in the accumulator to a low-pressure reservoir (next to 119).

60. The pressure control valve assembly of claim 59, the low-pressure reservoir being defined in part by a first actuating surface 119 of a dual acting piston.

61. The pressure control valve assembly of claim 60, fluid pressure in the low-pressure reservoir acting on the first actuating surface of the dual acting piston to compress a spring, energy being stored at the pre-load potential of the spring.

62. The pressure control valve assembly of claim 61, the regulating valve acting to selectively vent fluid pressure in the low-pressure reservoir, the venting acting to release the energy being stored at the pre-load potential of the spring to augment the pressure in the accumulator.

63. The pressure control valve assembly of claim 62, the released the energy stored at the pre-load potential of the spring acting to exert a pressure on a dual acting piston second actuating surface, the dual acting piston second actuating surface being in fluid communication with the accumulator.

64. The pressure control valve assembly of claim 63, the pressure acting on the dual acting piston second actuating surface acting to pressurize the accumulator during actuation of the actuator.

65. The pressure control valve assembly of claim 59, pressure in the low-pressure reservoir being controlled by a low-pressure regulator valve.

66. The pressure control valve assembly of claim 65, the low-pressure regulator valve maintaining pressure in the low-pressure reservoir at a lower value than a required low-level specification for the accumulator.

67. The pressure control valve assembly of claim 66, the low-pressure regulator valve having a spool, pressure in the low-pressure reservoir being regulated by known bias acting on the spool.

* * * * *